US005281889A

United States Patent [19]

Fields et al.

[11] Patent Number: 5,281,889

[45] Date of Patent: Jan. 25, 1994

[54] REFLECTOR LAMP HAVING A LIGHT-SOURCE CAPSULE SECURED BETWEEN MATING NECK AND REFLECTOR BODIES

[75] Inventors: Larry R. Fields; Chris Venicx, both of Richmond, Ky.

[73] Assignee: North American Philips Corporation, New York, N.Y.

[21] Appl. No.: 28,753

[22] Filed: Mar. 9, 1993

Related U.S. Application Data

[63] Continuation of Ser. No. 708,562, May 31, 1991, abandoned.

[51] Int. Cl.[5] ..... H01J 5/54

[52] U.S. Cl. ..... 313/113; 313/318; 362/310

[58] Field of Search ..... 313/113, 25, 318; 362/310, 439

[56] References Cited

U.S. PATENT DOCUMENTS

| | | | |
|---|---|---|---|
| 4,119,877 | 10/1978 | Grewe et al. | 313/318 |
| 4,370,587 | 1/1983 | Notelteirs | 313/113 |
| 4,755,711 | 7/1988 | Fields et al. | 313/113 |
| 4,829,210 | 5/1989 | Benson et al. | 313/25 |
| 4,958,266 | 9/1990 | Sorensen et al. | 362/310 |
| 4,982,131 | 1/1991 | Meyer et al. | 313/113 |
| 4,982,132 | 1/1991 | Meyer et al. | 313/113 |

FOREIGN PATENT DOCUMENTS

| | | |
|---|---|---|
| 2755432 | 8/1990 | Fed. Rep. of Germany . |
| 439266 | 12/1935 | United Kingdom . |
| 2043621 | 10/1980 | United Kingdom . |
| 2083696 | 3/1982 | United Kingdom . |

*Primary Examiner*—Donald J. Yusko
*Assistant Examiner*—Michael Horabik
*Attorney, Agent, or Firm*—Paul R. Miller

[57] ABSTRACT

A reflector lamp has a glass reflector body and a separate neck body which mates with the reflector body. A light-source capsule is insertable into a bore of the reflector body from its base end. A positioning member holds the light-source capsule and is clamped between the neck and reflector bodies to secure the light-source capsule in the reflector body. The reflector and neck bodies have surfaces which cooperate with the positioning member to position the light source capsule at the focus of the reflector when the reflector body, capsule and positioning member, and neck body are stacked together.

7 Claims, 2 Drawing Sheets

FIG. 2a
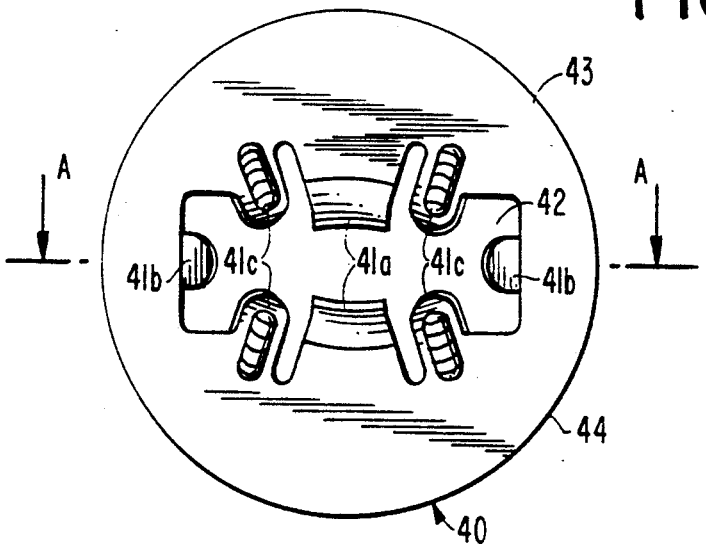
FIG. 2b
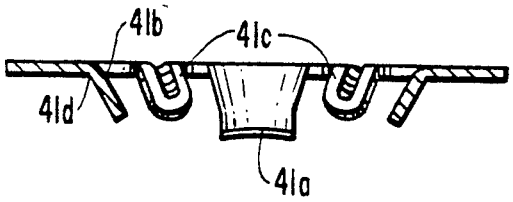
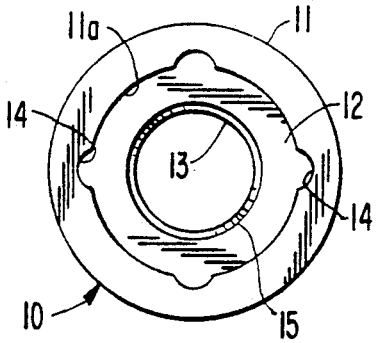
FIG. 3b
FIG. 3a
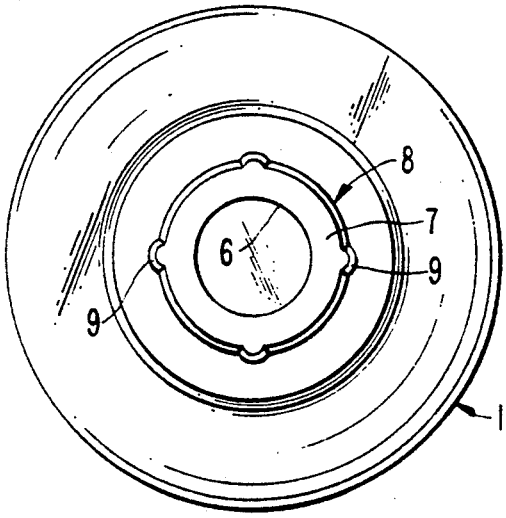

REFLECTOR LAMP HAVING A LIGHT-SOURCE CAPSULE SECURED BETWEEN MATING NECK AND REFLECTOR BODIES

This application is a continuation of previous application, Ser. No. 07/708,562, filed May 31, 1991, now abandoned and all benefits of such earlier application are hereby claimed for this application.

BACKGROUND OF THE INVENTION

1. Field of the Invention

The invention relates to reflector lamps having a light-source capsule in a vitreous reflector, and more particularly, to improved lamp structure for securing and aligning the light-source capsule with the reflector. The invention also relates to an improved method of assembly of reflector lamps employing a light-source capsule.

2. Description of the Prior Art

Molded or pressed glass reflector lamps, such as PAR lamps, generally have a reflector portion with a reflective surface and an integrally molded neck portion extending from the rear of the reflector portion. In lamps having a light-source capsule, the capsule is partially disposed within a neck bore, or cavity, which extends from an aperture in the throat of the reflective surface through the neck portion toward the lamp base. Conductive leads extending from the light-source capsule are electrically connected to respective contacts on the lamp base to permit application of an electric potential to the capsule to energize the capsule to emit light.

As used herein, the term "light-source capsule" includes a conventional tungsten filament incandescent capsule, tungsten-halogen capsule, a metal halide arc tube or capsule, a high pressure sodium ceramic arc tube, and any other light-emitting capsule or arc tube mountable within a reflector body.

The assembly of lamps having molded or pressed glass reflectors has historically been achieved by bringing the light-source in from the front of the reflector before further assembly operations, such as lens or base attachment, is performed. The light-source capsule has typically been secured and aligned in the reflector by cementing the capsule in the neck of the reflector, or by soldering, welding, or crimping heavy, rigid lead wires which extend from the capsule to metal parts near the base of the reflector. For glass reflectors including PAR 36, PAR 38, PAR 46, PAR 56, and PAR 64 types, the metal parts are ferrules pressed into and around holes provided in the neck near the lamp base. The light-source capsule is attached to the ferrules by brazing of the capsule lead wires as the first step in lamp assembly. For smaller PAR 20 and PAR 30 reflectors, there is not enough room to attach ferrules using existing glass forming techniques, so eyelets are attached through similar preformed holes. The light-source capsule is attached by crimping or soldering the lead wires to the eyelets. In the above lamps, the light-source capsule must then be focussed by burning the lamp, moving the capsule and bending the lead-wires to align the light-source with the reflector's optical axis. The focussing operation is difficult to automate, so it is typically a manual operation, which is time consuming and increases the cost of the lamp.

For even smaller reflectors such as MR16, MR11 and 35 mm types, even less space is available for preformed eyelet holes. One large hole or slot is formed in the reflector neck and the light-source is dropped in from the front of the reflector, focused, and its press seal cemented in place. Typically, a significant amount of adhesive is required to fill the space surrounding the press seal, which requires lengthy curing times of several hours that increase lamp cost.

Light-source capsules have also been secured within the neck portion of glass reflectors by positioning members secured to the pinch seal of the capsule. In U.S. Pat. No. 4,829,210 (Benson et al.) a disk-shaped positioning member is wedged in the tapered neck bore. However, this has the disadvantage that the small taper angle in the neck causes an appreciable variation in the axial positioning of the light capsule if extremely tight tolerances on the dimensions of the disk and taper angle are not met.

U.S. Pat. No. 4,755,711 (Fields et al.) shows a ceramic reflector lamp in which the halogen light-source is insertable from the rear of the ceramic reflector. The capsule is axially secured in the lamp by fixing the capsule lead-wires in a reservoir of cement in the base, requiring long curing times. The capsule is referenced to the focus of the reflector by reason of a metallic positioning cap, on the end of an elongate non-conventional press seal, which engages the end of internal flutes in the neck bore near the base. The flutes reduce the heat transfer from the capsule to the ceramic reflector.

Aluminized pressed glass reflectors are advantageous because they provide a superior and cost effective reflective surface as compared to reflectors of other materials. However, most glass reflectors require minimum draft angles, to allow for the release of the tooling from the hot glass after the reflector is pressed, which result in limitations in reflector geometry and consequently in lamp performance and assembly. Typically, draft angles of three degrees or more are required both inside and outside the reflector. Since these draft angles open to the front of the reflector, the minimum bore diameter for receiving the end of the light-source capsule, for example a press seal, is spaced from the reflective surface and the bore widens toward the reflective surface. The resulting aperture in the reflective surface is larger than the minimum bore diameter, resulting in a loss of effective reflector surface and reduced lamp efficacy. This is a particularly serious problem with smaller reflector lamps such as MR16's where the reflector surface is already small. The problem is even more serious if the length of the reflector neck must be long to meet maximum base temperature specifications, such as for lamps intended for deep fixtures.

It would be desirable to have a reference surface for the capsule light-source which is accessible from the rear of a pressed glass reflector. However, this is not practical using current glass pressing technology because of the draft angles which open to the front of the reflector. In addition, if a large outside neck diameter is required, as in the case of a lamp using a medium screw type base, the mass of glass which results if a small neck bore size is attempted cannot be reliably controlled using present glass pressing technology.

After the light-source capsule is secured in the reflector neck, a lens or glass cover is usually attached to the rim of the reflector, most commonly with an adhesive. However, water or chemical vapors from the adhesive can be introduced into the lamp between the reflector and lens during the adhesive curing process. If these vapors are not removed from the lamp, they can attack the reflector coating or cause increased gas pressure inside the reflector-lens assembly, which can force the lens to separate from the reflector. Since the light-source is secured in place before the lens is attached, some means of removing the adhesive vapors must be supplied. Usually an exhaust port at the rear of the reflector is used to flush out the vapors after curing, which port must then be sealed off using heat or adhesives. This additional operation also increases lamp cost.

Accordingly, it is an object of the invention to provide a reflector lamp which utilizes the advantages of a glass reflector but which facilitates automated lamp assembly.

A particular object is reduce the size of the aperture in the throat of the reflective surface, for a given neck length and capsule geometry, to increase the area of the reflective surface and improve lamp efficacy.

Still another object is to provide a lamp design that permits necks of increased length to reduce base temperatures without a corresponding decrease in the reflector surface area.

Still a further object is to provide a reflector lamp assembly which accurately locates the light-source capsule within the reflector to obviate the need for separately focusing the light-source with the reflector during lamp assembly.

Another object is to provide an assembly that minimizes the amount of adhesive inside the lamp and in which the curing of the adhesives does not reduce lamp performance.

SUMMARY OF THE INVENTION

The above objects are accomplished, according to the invention, by a reflector lamp having a vitreous reflector body having a bore for receiving the light-source capsule and a separate neck body fixed to the reflector body. The light-source capsule is insertable into the bore of the reflector body from the rear or base end of the reflector body and positioning means for securing and positioning the light-source capsule with the reflector body is fixed between the reflector and neck bodies. The positioning means may be an integrally molded portion of the capsule, such as a flange, or may be a separate positioning member which securely holds the light-source capsule.

Since the neck is a separate body, the diameter of the reflector bore and its aperture in the throat of the reflector surface are independent of the length of the neck body. The diameter of the reflector bore and its throat aperture are determined by the dimensions of the light-source capsule, the positioning means employed, and the mating geometry of the neck and reflector bodies. Thus, the length of the bore in the reflector body as well as the size of its opening in the reflector surface can be minimized to increase the surface area of the reflector and improve lamp efficacy.

According to an embodiment of the invention, the positioning means positions the center of the light source at the focus of the reflector. Preferably, the positioning means is a positioning member comprised of a generally planar disk which securely holds the light-source capsule and extends transverse to the axis of the light source within the capsule. The reflector body has a rear facing reference surface and the neck body has an opposing planar surface, both extending transverse to the optical axis of the reflector surface. The positioning disk is fixed between these opposing surfaces when the neck body is secured on the reflector body to align the light source with the optical axis. The axial distance between the center of the light source and the surface of the disk in contact with the reflector reference surface equals the axial distance between the focus of the reflector and said reflector reference surface to axially position the center of the light source at the focus of the reflective surface.

According to a preferred embodiment of the invention the neck and reflector bodies are mating parts which comprise an axially extending circumferential collar. An adhesive provided at the collar secures the reflector and neck bodies together. The axial length of the collar enhances alignment of the neck and reflector bodies and of the light-source capsule. The collar also provides sufficient surface area for the adhesive, providing a reliable joint between the reflector and neck bodies.

According to another embodiment of the invention, the neck and reflector bodies comprise locking means for locking the neck and reflector bodies against relative rotation. The locking means may comprise, for example, axially extending flutes on the reflector/neck body which engage in corresponding slots in the other of the neck/reflector bodies.

According to a preferred method of assembling the above lamp, a lens or cover is secured to the rim of the reflector with an adhesive prior to insertion of the light-source capsule in the reflector bore and securing of the neck on the reflector. This permits any vapors emitted by the adhesive during curing to escape out the open bore of the reflector.

For a better understanding of the invention, together with other objects, advantages, features, and capabilities thereof, reference is made to the following drawings and detailed description of the preferred embodiment.

BRIEF DESCRIPTION OF THE DRAWINGS

FIG. 2*a* is a bottom view of the positioning member for the light-source capsule;

FIG. 2*b* is a cross-section of the positioning member of FIG. 2*a* taken on the line A—A;

FIG. 3*a* is a rear-view of the reflector body showing the axially extending flutes; and FIG. 3*b* is a front view of the neck body showing the axially extending grooves which receive the flutes of the reflector body.

DESCRIPTION OF THE PREFERRED EMBODIMENT

Figure 1:
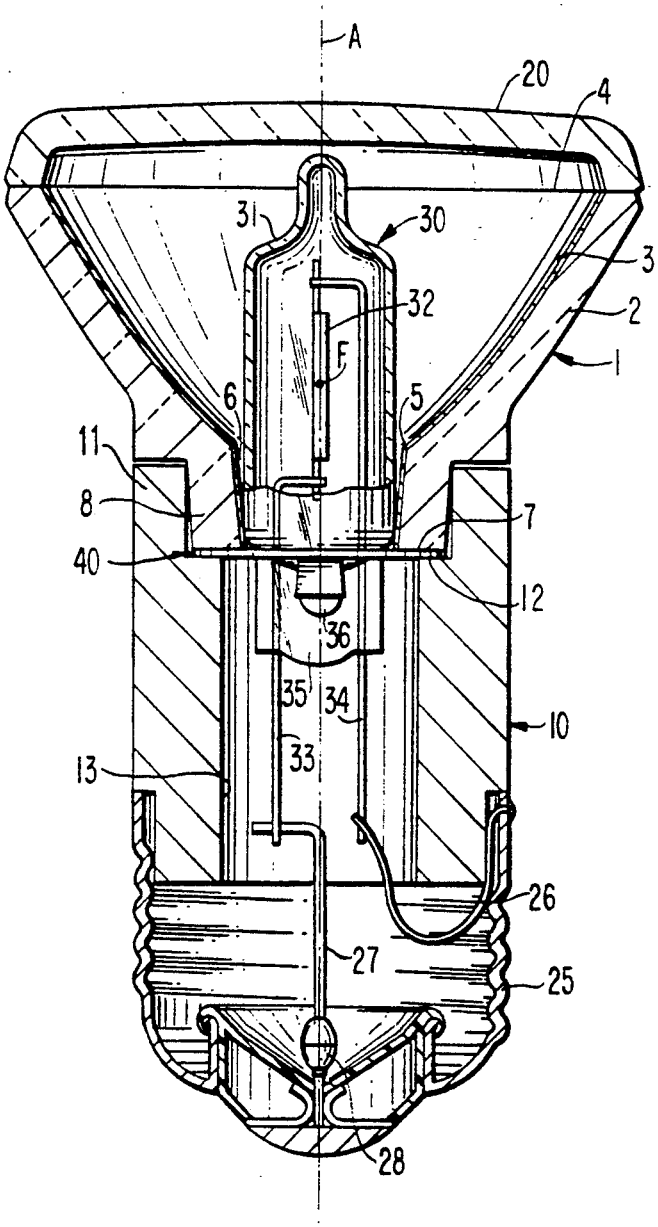
FIG. 1 is a partial cross-section illustrating a parabolic aluminized reflector (PAR) lamp according to the invention having a pressed glass reflector body, a separate neck body fixed to the reflector body, and a positioning member for the light-source capsule fixed therebetween.

FIG. 1 shows a parabolic aluminized reflector (PAR 16) lamp comprised of a pressed glass reflector body 1, a separate adjoining neck body 10, a lens 20 secured to the reflector 1, and a lamp cap or base 25. A light-source capsule 30 is secured in the reflector 1 by a positioning member 40 which is secured between the reflector body 1 and the neck body 10.

The light-source capsule 30 is a tungsten-halogen capsule having a construction which is well known in the art. A tungsten coil filament 32 is supported within the hard glass capsule 31 by conductive leads 33, 34 which extend through pinch seal 35 in a gas-tight manner. The capsule is filled with an inert gas such as nitrogen, argon, krypton, or xenon, or a mixture of such gases, along with a halogen compound such as bromine to support a tungsten-halogen transport cycle. The two major faces of pinch seal 35 each have a locating button 36 with a ridge transverse to filament 32. Application of an electric potential across leads 33, 34 energizes the filament to emit light.

Positioning means for holding capsule 30 and positioning it in the reflector body is comprised of a metallic circular-planar positioning member, or disk, 40. The disk 40 has an outer periphery 43 with a planar edge 44, and an aperture 42 which receives the pinch seal. (FIGS. *2a*, *2b*). The positioning member is secured to the pinch seal and aligned transverse to the capsule by a plurality of resilient tongues 41*a–c*. The locating button 36 of the pinch seal is engaged by respective tongues 41*a* to axially position the disk with respect to the capsule and the filament center. The positioning member 40 shown in FIG. 2 is metallic, more particularly, a cold-rolled stainless steel. However, ceramic, glass or other high temperature materials may be used. The positioning member may alternatively be secured to the capsule by a suitable adhesive.

The pressed glass reflector body 1 has a base end which includes a tubular flange 8 terminating at rear-facing reference surface 7. The flange 8 has a plurality of axially extending flutes 9 arranged about its circumference. (FIGS. 1, 3A) A tapered reflector bore 6 extends from the reference surface to an aperture 5 in the throat area of the reflective surface 3. The concave reflective surface 3 is parabolic and includes a light-reflective coating, such as aluminum, for reflecting light from capsule 30 out through the light transmitting reflector window bounded by rim 4 and lens 20. Alternatively, the reflective coating may be of the dichroic-type, which reflects visible light out through the lens and transmits infrared energy through the wall of the reflector body 1. The reflective surface 3 defines an optical axis "A" and a focus "F" on the optical axis. The bore 6 and aperture 5 are coaxial with the optical axis. As shown in FIG. 1, the glass capsule 31 has a clearance fit with the bore 6 at its smallest diameter which is located at the reference surface 7.

Neck body 10 is a separate cylindrical ceramic body having a circumferential collar 11 and a planar shoulder 12 for receiving the flange 8 of reflector body 1. The ceramic of neck body 10 is a steatite ceramic powder pressed at high pressure and glazed as is known in the industry. The planar shoulder 12 of neck body 10 and the planar reference surface 7 of reflector flange 8 are transverse to the optical axis and clamp the peripheral edge 44 of the planar periphery 43 of the positioning disk therebetween, ensuring that the filament 32 is aligned with optical axis "A". The filament 32 is centered on the optical axis by reason of the edges 41*d* of tongues 41*b* engaging chamfered edge 15 of neck bore 13, which is coaxial with the optical axis when assembled on flange 8. The light-source center, i.e. the center of filament 32, is axially located at the focus by reason of the axial distance between the center of the filament and the edge surface 43 of the positioning disk 40 in contact with reference surface 7 being equal to the distance between the reference surface 7 and the focus F.

Locking means for locking the neck and reflector bodies against relative rotation is comprised of the flutes 9 on flange 8 of the reflector body which mate with corresponding grooves or slots 14 in the circumferential collar 11. (FIGS. *3a*, *3b*) The neck and reflector bodies are axially fixed to each other by a chemically cured ceramic adhesive, such as "Sauereisen 29", disposed between the circumferential collar 11 and the reflector flange 8. Sauereisen 29 is commercially available from Sauereisen Cements of Pittsburgh, Pa. and is a high temperature insulating cement which contains silica, zirconium silicate, sodium fluoride, and sodium silicate. Other suitable cements include Sauereisen 10, Caulk 100 and various Dylon and Aremco brand cements. Instead of ceramic, the neck body 10 may be a high temperature thermoplastic such as "Ultem", available from General Electric, or may be glass or metallic.

The conductive leads 33, 34 of the light-source capsule 30 extend through cavity 13 of the neck body and are connected to respective contacts on the screw base 25 in a conventional manner by lead wire 26 and lead wire 27 which includes diode 28.

Assembly of the lamp is performed by stacking components starting with the lens. The lens 20 is joined to the rim of the reflector body 2 in a conventional manner using a heat cured epoxy which is cured by a predetermined curing schedule. Any vapors produced during the curing process escape through the open bore 6 of the reflector. The light-source capsule 30 is then inserted from the rear of the reflector body through the reflector bore 6 until the positioning member 40 is seated against the reference surface 7 of the reflector. A thin layer of the ceramic adhesive is provided between the disk of the positioning member, the reference surface 7 of the reflector, and shoulder 12 of the neck body to allow for the different expansion coefficients of the metallic positioning member, the glass reflector, and the ceramic neck. A thin layer of the ceramic adhesive is also applied to the inner surface of the circumferential collar 11 and the opposing outer surface of flange 8. Next, the flutes 9 of the reflector are aligned with the grooves 14 of the circumferential collar 11 and the neck body is assembled onto the reflector body and the adhesive material is allowed to cure. The lamp base 25 is then secured to the neck body 10 with adhesives in a conventional manner. The base is also peened to the neck body to press metal into grooves formed in the neck body (not shown) to rotationally lock the base to the neck body. Both leads 27 and 26 are then connected to the respective base contacts by welding or soldering and the base adhesive is cured per a predetermined schedule.

The combination of a vitreous reflector body with a separate neck body permits the bore 6 which opens to the reflector to have a length which is significantly less than prior art lamps having an integral neck. Thus, the bore does not increase substantially in size as it extends from the reference surface 7 to the aperture 5 at the reflector surface 3. This maximizes the reflector surface and increases lamp efficacy. In the PAR 16 lamp according to the invention (FIG. 1) the diameter of the reflector aperture 5 was decreased by 16%, to 0.581 inches from 0.697 inches for a corresponding conventional pressed-glass PAR 16 lamp having an integral glass neck. The decreased aperture resulted in an increase of 7% in effective reflector surface and an increase of 20% in lamp lumens versus the conventional PAR 16 lamp having the same light-source capsule.

The lamp construction provides self-alignment of the light-source capsule with the optical axis by reason of the cooperation of the positioning member 40, shoulder 12, reference surface 7, and collar 11, as described above. This eliminates the need to manually align the light-source capsule, as was necessary in prior art lamps having capsule lead wires secured to ferrules or eyelets, or secured by adhesives in the neck. The self-alignment of the capsule as well as the "stacking" method of assembling the lamp facilitates automation of the lamp. The mating geometry of the neck and reflector bodies requires only thin layers of adhesive, thus avoiding lengthy curing times. Since the light-source is insertable from the rear of the reflector body, the lens or cover may be adhered to the reflector body first, obviating the need to provide an exhaust port for adhesive vapors.

In addition, the limitations of glass technology that make a long reflector neck with thick walls impractical to manufacture consistently are overcome by using a separate ceramic neck body. A separate neck body also provides a more desirable means of reducing the base temperature of the lamp because the neck can be lengthened without increasing the size of the aperture 5 and reducing the area of reflective surface 3, since the dimensions of reflector bore 6 are independent of the neck length chosen.

The use of an opaque neck body, such as metal or ceramic, is advantageous for preventing stray light from passing through the neck of the bulb. This was a problem in conventional PAR lamps which had long necks because it is difficult to aluminize an elongated neck. A ceramic neck body is also advantageous in that a coloring agent may be readily added to the ceramic material or a colored glaze use to improve lamp cosmetics.

Providing colored necks on conventional PAR lamps is more difficult because high temperature coatings can be expensive and/or difficult to apply.

Those of ordinary skill in the art will appreciate that various modifications can be made in the shape, arrangement and interconnection of the reflector and the neck bodies, the light-source capsule and the positioning member without departing from the scope of the invention. For example, instead of tongue edges 41*d* engaging the chambered edge 15 of the neck, the light-source may be centered by reason of close tolerances between an outer edge 44 of the positioning disk and the inner surface 11*a* of collar 11. Additionally, the positioning means may comprise an integral collar, for example a molded glass collar of a glass capsule, which is clamped between the neck and reflector bodies instead of a separate member fixed to the light-source capsule.

What is claimed is:

1. A reflector lamp construction having improved efficacy and increased reflective surface area comprising (a) a light source capsule having a lighting structure extending along an optical axis, (b) reflector structure having a reflective surface and an opening at said optical axis through which said light source capsule is disposed, said opening only being of a size to substantially enclose said light source capsule at one end, (c) a lens cap enclosing said reflector structure for projecting light from said light source capsule and reflected light from said reflective surface, (d) structural means for reducing temperature without decreasing reflective surface area of said reflective surface, said structural means including a neck body structure that is separate from said reflector structure and extends from said reflector structure to a lamp base, (e) positioning means disposed between said reflector structure and said neck body structure for accurately and securely positioning said light source capsule within said reflector structure along said optical axis to obviate separate focussing of light from said lighting structure during lamp assembly, said positioning means being a flat, circular element having an opening with adjacent fittings at an edge of said opening, said opening being of a size to hold said one end of said light source capsule, said light source capsule then being aligned along said optical axis, (f) locking means disposed on an end of said reflector structure and a part of said neck body structure for preventing rotation between said reflector structure and said neck body structure, and (g) a lamp base structure disposed at an end of said neck body structure opposite to said reflector structure, said lamp base structure including electrical connections for said lamp source capsule.

2. A reflector lamp construction according to claim 1, wherein said neck body structure has a circumferential edge coaxial with said optical axis, and said positioning means has a plurality of tongues engaging said circumferential edge for centering said light source capsule with said optical axis.

3. A reflector lamp construction according to claim 1, wherein said neck body structure includes an extended collar surrounding an end portion of said reflector structure at said one end.

4. A reflector lamp construction according to claim 1, wherein the axial distance between a center of said lighting structure and said positioning means disposed against said reflector structure equals the axial distance between said positioning means and a focus of said reflective surface.

5. A reflector lamp construction according to claim 4, wherein means are included for centering and aligning said center of said lighting structure with said optical axis when said positioning means is seated between said reflector structure and said neck body structure.

6. A reflector lamp construction according to claim 1, wherein said neck body structure is opaque.

7. A reflector lamp construction according to claim 6, wherein neck body structure is ceramic and has a colored outer surface.

* * * * *